US005568969A

United States Patent [19]

Yu

[11] Patent Number: 5,568,969

[45] Date of Patent: Oct. 29, 1996

[54] CONVERTIBLE LIGHT ASSEMBLY

[76] Inventor: Jack Yu, No. 109-1, Avenue 6, Lane 164, Tzong Sa Road, Da Du Hsiang, Taichung Hsien, Taiwan

[21] Appl. No.: 620,175

[22] Filed: Mar. 22, 1996

[51] Int. Cl.[6] ..... F21S 1/04

[52] U.S. Cl. ..... 362/404; 362/147; 362/397; 248/343; 416/5

[58] Field of Search ..... 362/404, 406, 362/407, 147, 226, 285, 396; 248/342, 343, 344, 317; 416/5

[56] References Cited

U.S. PATENT DOCUMENTS

| | | | |
|---|---|---|---|
| 1,717,877 | 6/1929 | Olier, Jr. | 362/404 |
| 1,841,727 | 1/1932 | Glowacki | 362/404 |
| 3,362,670 | 1/1968 | Sclafani | 362/404 |
| 4,001,574 | 1/1977 | Porter et al. | 362/404 |
| 4,303,968 | 12/1981 | Goralnik | 362/147 |
| 5,292,228 | 3/1994 | Dye | 416/5 |
| 5,349,513 | 9/1994 | Taylor, III | 362/404 |

*Primary Examiner*—James C. Yeung
*Attorney, Agent, or Firm*—Charles E. Baxley, Esq.

[57] ABSTRACT

A light assembly includes a lower canopy for securing a lamp shade and having a socket for engaging with a lamp. A bolt sleeve has a lower portion secured to the lower canopy. A bar is secured to a ceiling and includes two slots for securing a ceiling canopy. Another bolt sleeve is engaged through the ceiling canopy and is engaged with the bar. Two couplers are secured to the bolt sleeves and each has a ring for engaging with a chain so as to form a pendent light. The lower canopy may be secured to the ceiling canopy so as to form an overhead lamp.

1 Claim, 6 Drawing Sheets

CONVERTIBLE LIGHT ASSEMBLY

BACKGROUND OF THE INVENTION

1. Field of the Invention

The present invention relates to a light, and more particularly to a convertible light assembly.

2. Description of the Prior Art

Typical ceiling fan lights and typical pendent lamps and typical overhead lights include different configurations and may not be converted from each other such that the users have to buy many different light devices.

The present invention has arisen to mitigate and/or obviate the afore-described disadvantages of the conventional lights.

SUMMARY OF THE INVENTION

The primary objective of the present invention is to provide a convertible light assembly which may be converted from a pendent light to an overhead lamp and to a light for a ceiling fan.

In accordance with one aspect of the invention, there is provided a light assembly comprising a lower canopy for securing a lamp shade thereto, the lower canopy including a socket secured thereto for engaging with a lamp and including a first bolt sleeve extended upward therefrom, a nut including a lower portion for engaging with the first bolt sleeve and including an upper portion, a second bolt sleeve including a lower portion engaged with the upper portion of the nut and including an upper portion, at least one cover engaged on the lower canopy and including an aperture formed therein for engaging with the second bolt sleeve, a first coupler including an inner thread formed therein for engaging with the upper portion of the second bolt sleeve so as to be secured to the second bolt sleeve, the first coupler including a first ring secured thereto, a bar for securing to a ceiling, the bar including two slots formed therein for engaging with fastening means and including a screw hole formed therein, a ceiling canopy including a bore formed therein, means for securing the ceiling canopy to the bar, a third bolt sleeve engaged through the bore of the ceiling canopy and including an upper portion for engaging with the screw hole of the bar so as to be secured to the bar, the third bolt sleeve including a lower portion, a second coupler including an inner thread formed therein for engaging with the third bolt sleeve so as to be secured to the third bolt sleeve and for securing the ceiling canopy to the third bolt sleeve, the second coupler including a second ring secured thereto, and a chain including two ends secured to the first ring and the second ring of the first and the second couplers so as to couple the lower canopy to the ceiling canopy and so as to form a pendent light. The third bolt sleeve is engaged with the nut in order to secure the lower canopy to the ceiling canopy so as to form an overhead lamp when the chain and the first and the second couplers and the second bolt sleeve and the cover are removed. The first bolt sleeve may also be adapted to be engaged with a control box of a ceiling fan so as to form a ceiling fan light, such that the light assembly may be converted to either a pendent light or an overhead lamp or a ceiling fan light.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
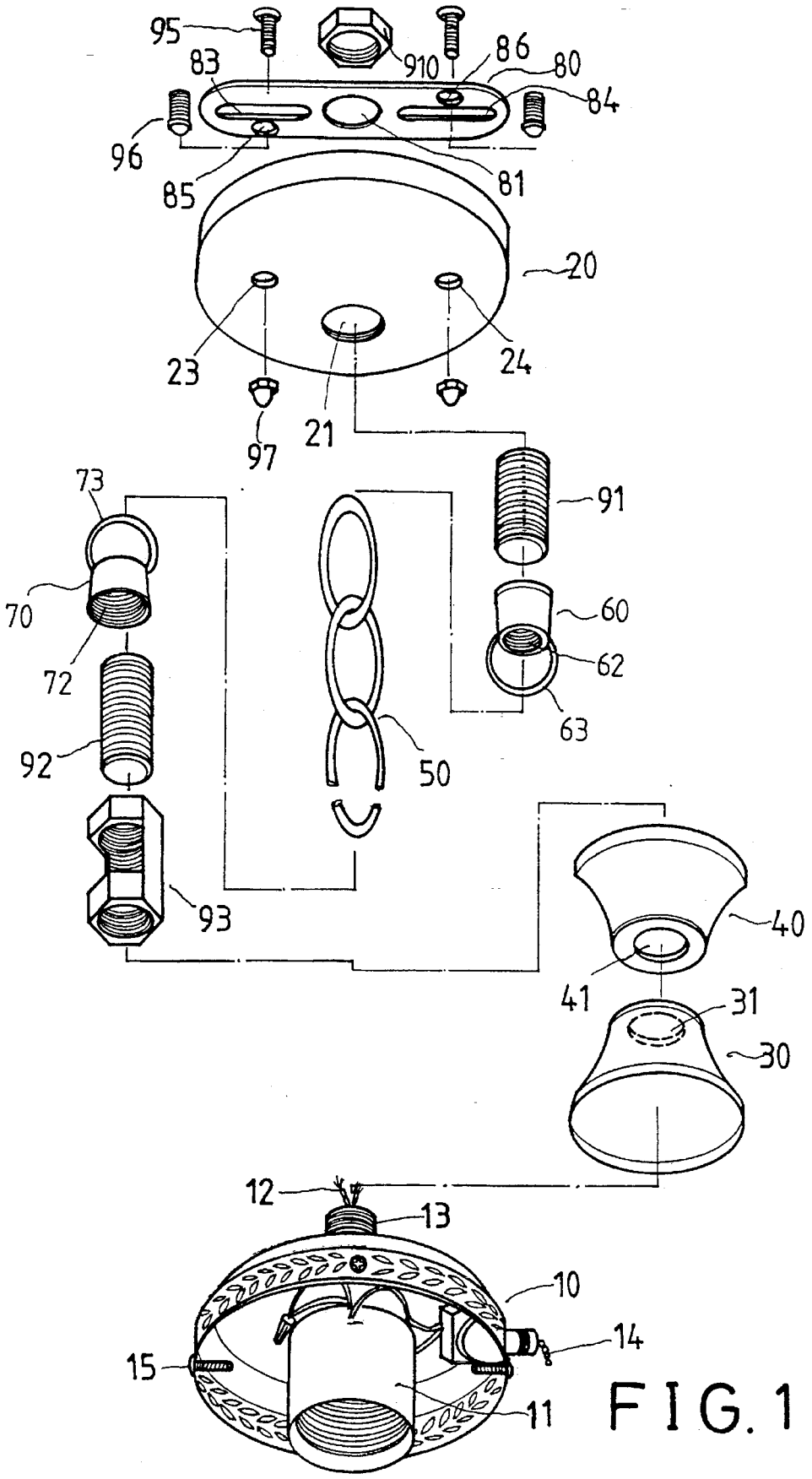
FIG. 1 is an exploded view of a convertible light assembly in accordance with the present invention.
Figure 2:
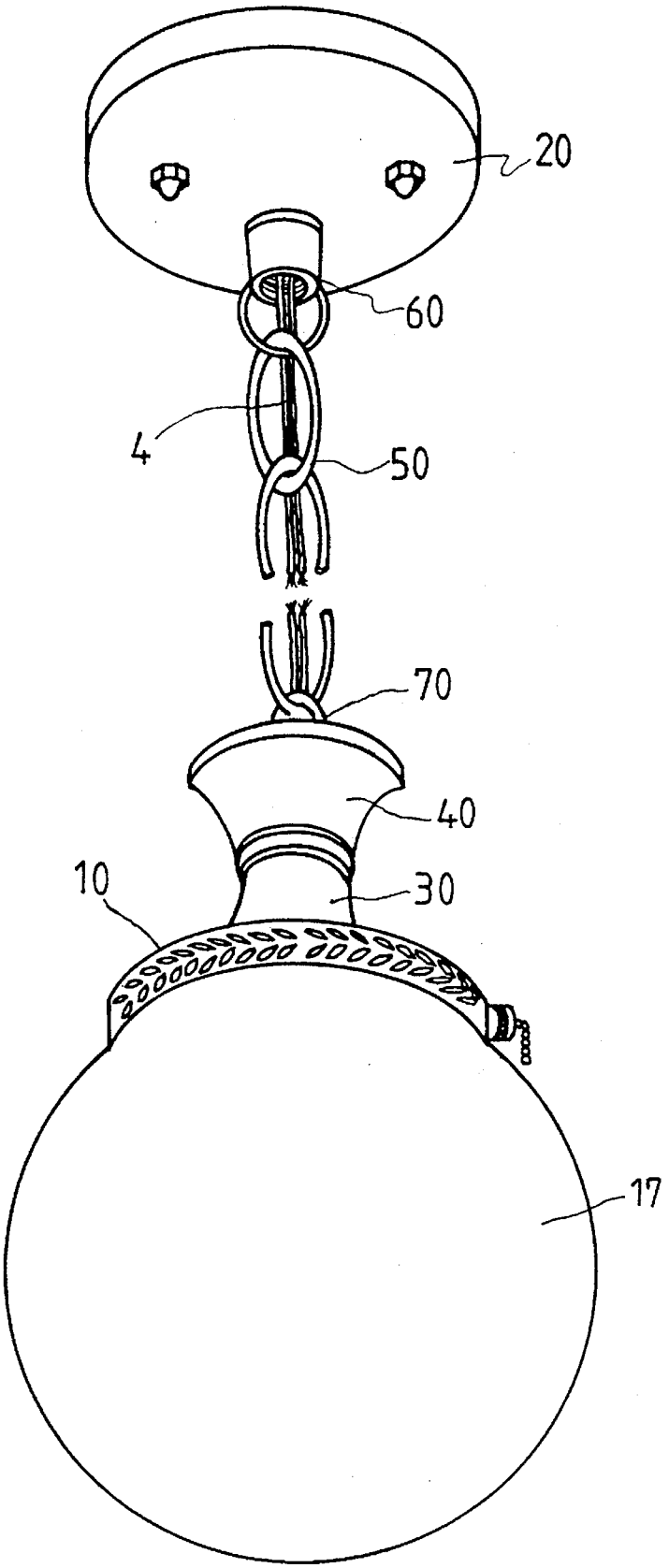
FIG. 2 is a perspective view of the convertible light assembly assembled as a pendent light.
Figure 3:
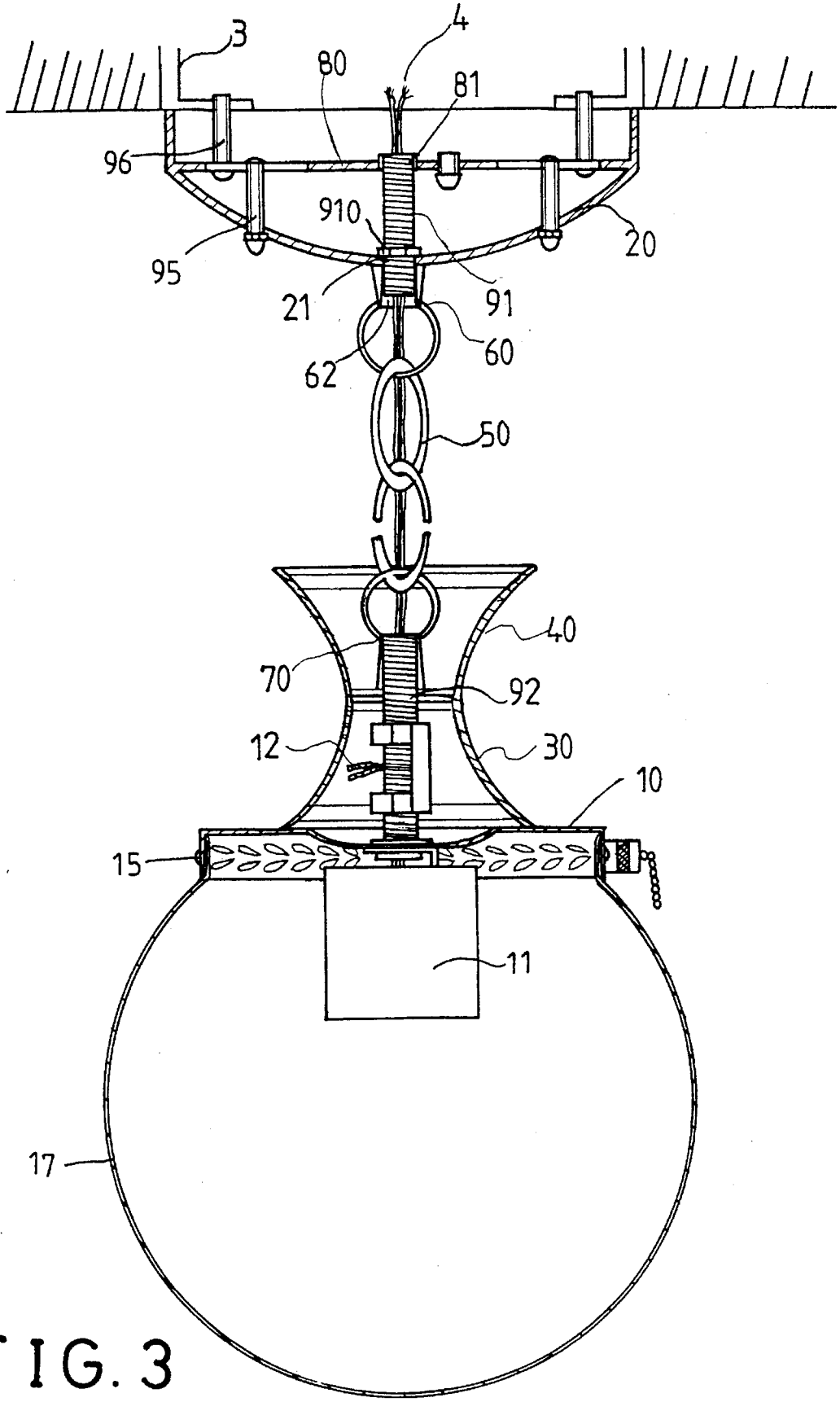
FIG. 3 is a cross sectional view of the pendent light as shown in FIG. 2.

Referring to the drawings, and initially to FIGS. 1 to 3, a convertible light assembly in accordance with the present invention comprises a lower canopy 10 including a number of screws 15 secured to the peripheral portion for securing a lamp shade 17 to the canopy 10. A socket 11 is secured to the lower canopy 10 for engaging with a lamp and an electrical wire 12 is coupled to the socket 11. A switch 14 is secured to the side portion of the lower canopy 10 for controlling the electrical power to the socket 11. The lower canopy 10 includes a bolt sleeve 13 extended upward therefrom. Two covers 30, 40 are engaged on the lower canopy 10 and each includes an aperture 31, 41 formed therein for engaging with a bolt sleeve 92. A nut 93 includes a lower portion engaged with the bolt sleeve 13 and includes an upper portion engaged with the bolt sleeve 92. A coupler 70 includes an inner thread 72 formed therein for engaging with the bolt sleeve 92 so as to be secured to the bolt sleeve 92. The coupler 70 includes a ring 73 secured thereto for engaging with a chain 50. The covers 30, 40 are provided for covering the bolt sleeves 13, 92 and the nut 93 and the coupler 70. The electric wire 4 from the junction box 3 may engage through the bolt sleeves 91 and 92 so as to engage with the electric wire 12.

A bar 80 includes two holes 85, 86 for engaging with screws 96 which may secure the bar 80 to the junction box 3 (FIG. 3); and includes two slots 83, 84 formed therein for engaging with screws 95 which may engage with nuts 97. The bar 80 includes a screw hole 81 for engaging with a bolt sleeve 91 such that the bolt sleeve 91 may be secured to the bar 80. A ceiling canopy 20 includes a bore 21 formed therein for engaging with the bolt sleeve 91 which is engaged with a nut 910; and includes two holes 23, 24 for engaging with the screws 95 and nuts 97 which may secure the ceiling canopy 20 to the ceiling and the like. Another coupler 60 includes an inner thread 62 for engaging with the bolt sleeve 91 so as to secure the ceiling canopy 20 to the bolt sleeve 91. The coupler 60 includes a ring 63 secured thereto for engaging with the chain 50. Accordingly, the convertible light assembly may be assembled as a pendent light as shown in FIGS. 2 and 3.

Figure 4:
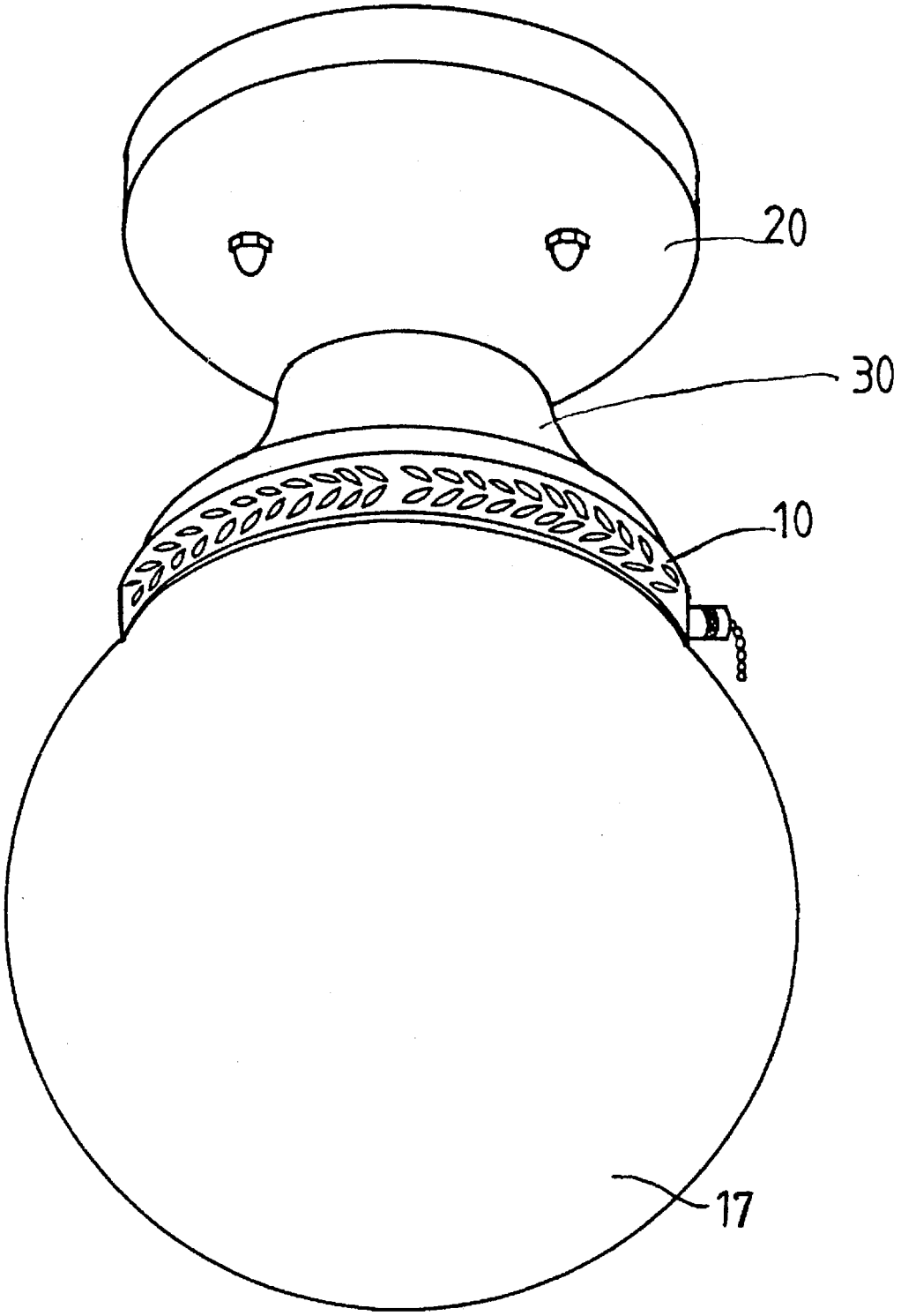
FIG. 4 is a perspective view of the convertible light assembly assembled as an overhead lamp.
Figure 5:
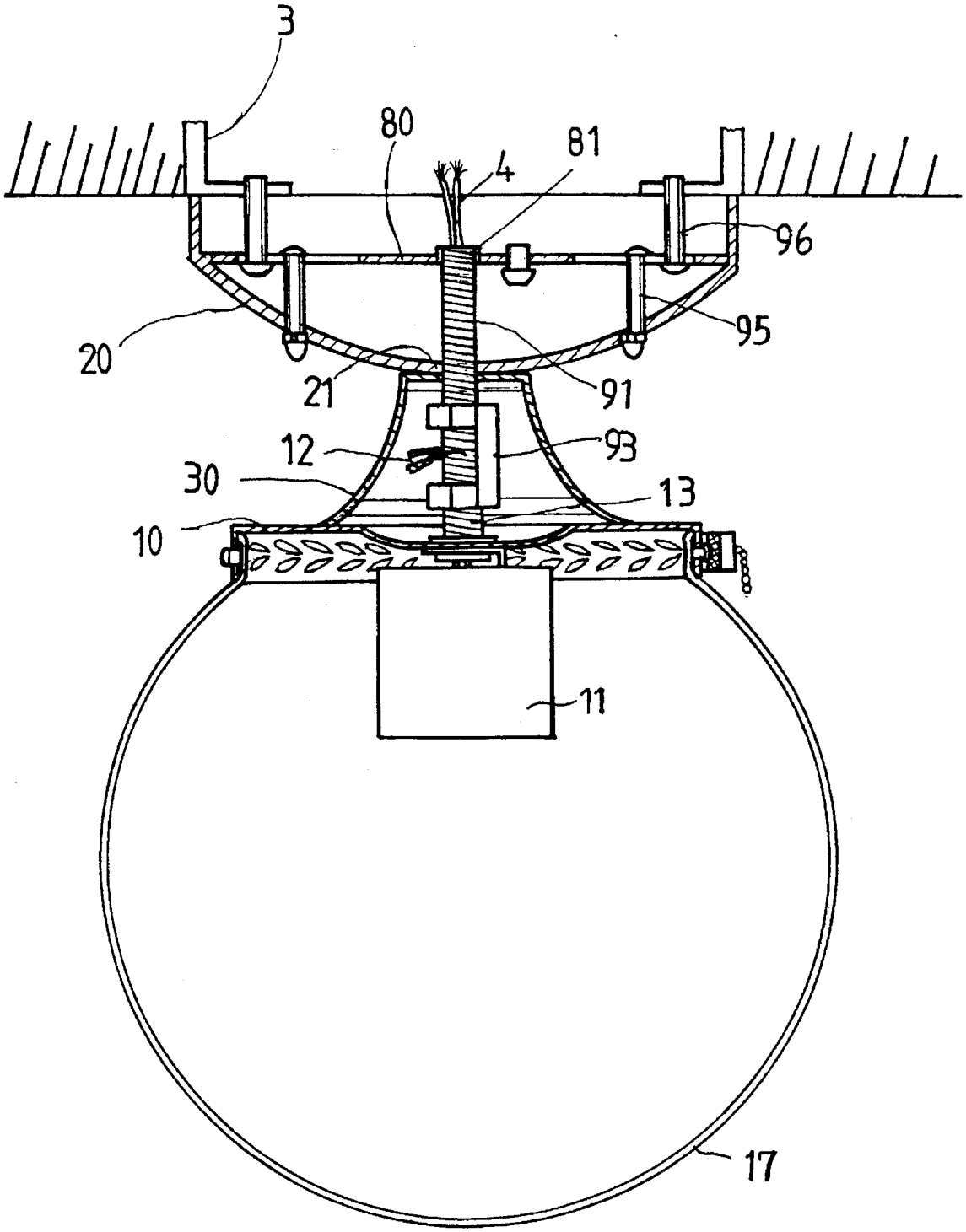
FIG. 5 is a partial cross sectional view of the overhead lamp as shown in FIG. 4.

Referring next to FIGS. 4 and 5, when the chain 50 and the couplers 60, 70 and the bolt sleeve 92 and the cover 40 are removed, and when the bolt sleeve 91 is engaged with the nut 93, the lower canopy 10 may be directly secured to the ceiling canopy 20 so as to form an overhead lamp.

Figure 6:
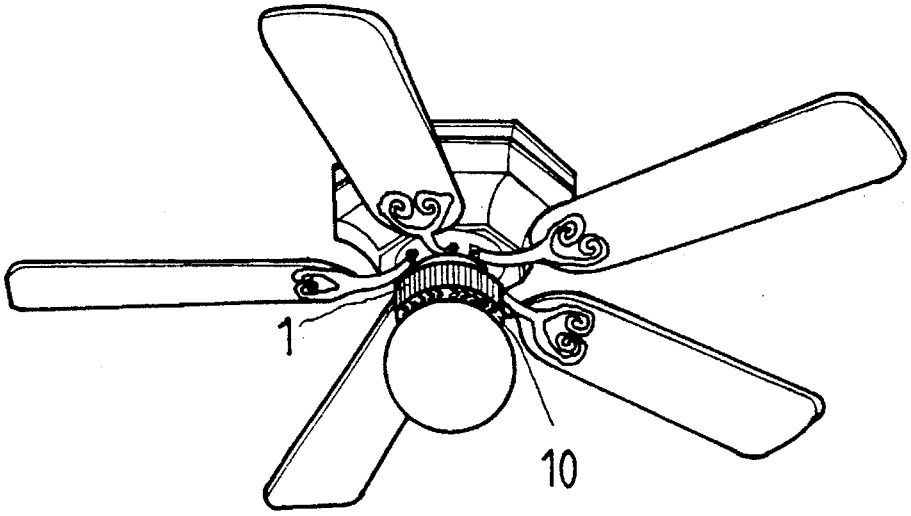
FIG. 6 is a perspective view of the convertible light assembly assembled as a light for attaching to a ceiling fan.
Figure 7:
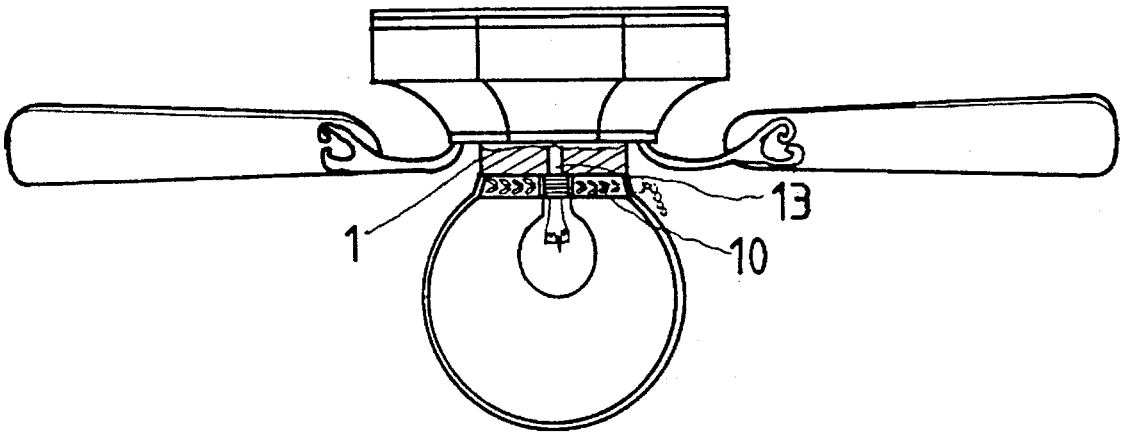
FIG. 7 is a partial cross sectional view of the ceiling fan light as shown in FIG. 6.

Referring next to FIGS. 6 and 7, the bolt sleeve 13 of the lower canopy 10 may be directly engaged with the control box 1 of a ceiling fan so as to form a ceiling fan light.

Accordingly, the convertible light assembly in accordance with the present invention includes a configuration that may be assembled as either a pendent light or an overhead lamp or a light for a ceiling fan.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light assembly comprising:

a lower canopy for securing a lamp shade thereto, said lower canopy including a socket secured thereto for engaging with a lamp and including a first bolt sleeve extended upward therefrom, a nut including a lower portion for engaging with said first bolt sleeve and including an upper portion, a second bolt sleeve including a lower portion engaged with said upper portion of said nut and including an upper portion, at least one cover engaged on said lower canopy and including an aperture formed therein for engaging with said second bolt sleeve, a first coupler including an inner thread formed therein for engaging with said upper portion of said second bolt sleeve so as to be secured to said second bolt sleeve, said first coupler including a first ring secured thereto, a bar for securing to a ceiling, said bar including two slots formed therein for engaging with fastening means and including a screw hole formed therein, a ceiling canopy including a bore formed therein, means for securing said ceiling canopy to said bar, a third bolt sleeve engaged through said bore of said ceiling canopy and including an upper portion for engaging with said screw hole of said bar so as to be secured to said bar, said third bolt sleeve including a lower portion, a second coupler including an inner thread formed therein for engaging with said third bolt sleeve so as to be secured to said third bolt sleeve and for securing said ceiling canopy to said third bolt sleeve, said second coupler including a second ring secured thereto, and a chain including two ends secured to said first ring and said second ring of said first and said second couplers so as to couple said lower canopy to said ceiling canopy and so as to form a pendent light, said third bolt sleeve being engaged with said nut in order to secure said lower canopy to said ceiling canopy so as to form an overhead lamp when said chain and said first and said second couplers and said second bolt sleeve and said cover are removed, and said first bolt sleeve being adapted to be engaged with a control box of a ceiling fan so as to form a ceiling fan light.

* * * * *